US007048215B2

(12) United States Patent
Irwin

(10) Patent No.: US 7,048,215 B2
(45) Date of Patent: May 23, 2006

(54) COMMINUTING APPARATUS HAVING SCREEN AND ACCESS TRAY

(76) Inventor: Jere F. Irwin, P.O. Box 10668, 2601 W. "J" St., Yakima, WA (US) 98902

( * ) Notice: Subject to any disclaimer, the term of this patent is extended or adjusted under 35 U.S.C. 154(b) by 0 days.

(21) Appl. No.: 10/779,219

(22) Filed: Feb. 13, 2004

(65) Prior Publication Data

US 2004/0159725 A1 Aug. 19, 2004

Related U.S. Application Data

(60) Continuation of application No. 09/998,226, filed on Dec. 3, 2001, now Pat. No. 6,695,239, which is a division of application No. 09/335,142, filed on Jun. 16, 1999, now Pat. No. 6,357,680.

(51) Int. Cl.
*B02C 18/16* (2006.01)

(52) U.S. Cl. ..... 241/73; 241/236; 241/285.3

(58) Field of Classification Search ..... 241/236, 241/60, 73, 285.2, 285.3
See application file for complete search history.

(56) References Cited

U.S. PATENT DOCUMENTS

| | | | | |
|---|---|---|---|---|
| 2,595,117 A | | 4/1952 | Ahlmann | |
| 3,055,597 A | | 9/1962 | Mund | |
| 3,229,698 A | | 1/1966 | Johansson et al. | |
| 3,310,059 A | | 3/1967 | Grizinger | |
| 3,627,211 A | | 12/1971 | Leach | 241/3 |
| 3,724,766 A | | 4/1973 | Bosland | 241/36 |
| 4,134,556 A | | 1/1979 | Ehrlich et al. | 241/79.3 |
| 4,161,296 A | | 7/1979 | Parker et al. | 241/152 A |
| 4,321,027 A | | 3/1982 | Stoehr et al. | 425/216 |
| 4,355,766 A | | 10/1982 | Wigand | 241/222 |
| 4,385,732 A | | 5/1983 | Williams | 241/167 |
| 4,422,581 A | | 12/1983 | Chryst | 241/66 |
| 4,557,421 A | * | 12/1985 | Probst et al. | 241/73 |
| 4,687,144 A | | 8/1987 | Irwin et al. | 241/49 |
| 4,693,428 A | | 9/1987 | Raterman et al. | 241/167 |
| 5,039,020 A | | 8/1991 | Leuthold et al. | 241/30 |
| 5,141,168 A | | 8/1992 | Pepper | 241/236 |
| 5,248,100 A | | 9/1993 | Arakawa | 241/34 |
| 5,427,321 A | | 6/1995 | Takahashi et al. | 241/73 |
| 5,609,307 A | | 3/1997 | Rota | 241/73 |
| 5,836,527 A | | 11/1998 | Irwin et al. | 241/49 |
| 5,860,607 A | | 1/1999 | Irwin | 241/80 |
| 5,893,523 A | | 4/1999 | Irwin | 241/60 |

FOREIGN PATENT DOCUMENTS

| | | |
|---|---|---|
| DE | 3614-028 A1 | 10/1987 |
| GB | 745176 | 2/1956 |
| SU | 1556-745 A | 4/1990 |
| WO | WO 95/33566 | 12/1995 |

OTHER PUBLICATIONS

Flier entitled *Broyeur "Le Compact"*, undated, from the K2001 International Trade Fair for Plastics and Rubber, in Düsseldorf, Germany.

* cited by examiner

*Primary Examiner*—Mark Rosenbaum
(74) *Attorney, Agent, or Firm*—Wells St. John P.S.

(57) ABSTRACT

A comminuting apparatus is provided with a housing, at least two intermeshing scissor rolls, a screen, and an access tray. The housing has an entrance opening for receiving waste material and an exit opening for removing subdivided waste material. The scissor rolls are carried within the housing between the entrance opening and the exit opening for subdividing the waste material. The screen is carried by the housing between the scissor rolls and the exit opening. The access tray is provided by the housing and is removably supported downstream of the screen to provide a shear outtake manifold between the screen and the access tray.

25 Claims, 9 Drawing Sheets

10
110
116
72
112
II
II
114
74
68
38
18
24
16
38
36
36
64
33
60
35
32
62
50
52
20
38
66
22
36
78
92
38
36
90
70

64
24
157
157
186
170
66
170
168
180
160
160
162
20
50
52
162

168
170
176
170
176

COMMINUTING APPARATUS HAVING SCREEN AND ACCESS TRAY

RELATED PATENT DATA

This patent application is a continuation application of pending U.S. patent application Ser. No. 09/998,226, filed Dec. 3, 2001, now U.S. Pat. No. 6,695,239 entitled "Self-Feeding Comminuting Apparatus Having Improved Recirculation Features", naming Jere F. Irwin as inventor, which in turn was a divisional application of U.S. patent application Ser. No. 09/335,142, filed Jun. 16, 1999, originally entitled "Self-Feeding Comminuting Apparatus Having Improved Drive Motor and Recirculation Features" and later amended to "Self-Feeding Comminuting Apparatus Having Improved Drive Motor Features", and which is now U.S. Pat. No. 6,357,680 B1, issued Mar. 19, 2002, the disclosure of both of which is incorporated by reference.

TECHNICAL FIELD

This invention relates to apparatus for comminuting solid waste materials such as plastic sheet material.

BACKGROUND OF THE INVENTION

The manufacture and forming of many products from plastic produces significant amounts of plastic waste material. Applicant has previously invented several unique apparatus for comminuting severable waste material, particularly plastic sheet material, into small, rather uniform particles or pieces that can be readily recycled or disposed of in an environmentally acceptable manner. Several generations of product line have been sold by Irwin Research & Development, Inc., under the product name "Chesaw" and have gained commercial success. One such prior invention is the subject of the Irwin, et al., U.S. Pat. No. 4,687,144 granted Aug. 18, 1987. Other such prior inventions are the subject of U.S. Pat. Nos. 5,836,527; 5,860,607; and 5,893,523.

The first prior invention of U.S. Pat. No. 4,687,144 was a vast improvement over various types of hammermills that had previously been used. The hammermills were quite bulky, extremely noisy, and prone to substantial damage when the mill received foreign material that it could not comminute. Although such prior Irwin, et al., invention was a vast improvement and was commercially successful, particularly in view of hammermills, it was rather expensive to manufacture and sometimes noisy in operation when processing certain materials. Furthermore, it was unable to satisfactorily comminute rather high density plastic materials.

The remaining prior inventions identified above were directed to improvements over the invention of U.S. Pat. No. 4,687,144. Such improvements were directed to improving the amount of comminuted material that could be generated in a given amount of time, to improve the manner in which the comminuting apparatus operated, and/or to enhance the ability of the comminuting apparatus to efficiently subdivide pieces of material that are otherwise difficult to comminute.

As an example, U.S. Pat. No. 5,836,527 was an improvement over the invention of U.S. Pat. No. 4,687,144. More particularly, an improved comminuting apparatus is provided which can significantly increase the amount of comminuted material produced in a given amount of time. Such device is relatively less expensive to manufacture, and is quieter to operate. Such apparatus provides an ability to comminute a wider variety of solid waste materials. More particularly, the solid waste comminuting apparatus carries material that is severed in the device via an airstream through a fan. Subdivided pieces of material are directed via the fan to a separator screen which is mounted within a centrifugal housing. The airstream carries small pieces through the separator screen into an outer volute chamber for discharge from the apparatus. Large pieces which are not capable of passing through the separator screen are recycled through a recycle outlet and a recycle conduit back to scissor rolls of the device for further size reduction. However, the complexity of the apparatus and the number of parts needed to construct the apparatus increased over the device of U.S. Pat. No. 4,687,144, which has proven undesirable for certain applications.

As another example, U.S. Pat. No. 5,860,607 is directed to an apparatus for comminuting waste materials, and includes a feed roll for feeding a continuous sheet of waste material into a shear intake manifold at a desired line speed and directing the waste material to scissor rolls. An additional feature includes a screw conveyor for recirculating subdivided pieces of comminuted material. More particularly, a feed roll delivers solid waste material into overlapping scissor rolls at a desired line speed. A pneumatic conveyor, in the form of an Archimedes screw, delivers the subdivided pieces of comminuted material for sorting and reprocessing. However, this improvement also increased the complexity of the comminuting apparatus, requiring a feed roll and a screw conveyor in addition to a pair of scissor rolls.

As yet another example, U.S. Pat. No. 5,893,523 is directed to an apparatus for comminuting waste material having feed roll delivery features. A feed roll is rotatably carried by a frame for directing waste material to a set of overlapping scissor rolls which shear waste material into subdivided pieces as the material passes between the scissor rolls. A separator screen is carried by the frame in association with at least one of the scissor rolls for separating subdivided pieces having a size less than a predetermined size, and for recirculating subdivided pieces having a size greater than a predetermined size. However, a separate feed roll is needed in addition to a pair of scissor rolls.

The present invention provides a vastly improved comminuting apparatus that is not only able to process significantly greater amounts of material in a given time, it is also better able to recirculate and sort severed solid waste material utilizing an apparatus that is formed with a simplified construction having fewer moving parts, proving more reliable, less costly to manufacture, and maintain and repair, and is more efficient to operate. It is also better able to sever a wider variety of different types of materials over a broader range of line speeds, in a feed-controlled manner from a web of material being received from a processing machine. Accordingly, the present invention provides an apparatus that is able to feed solid waste material into the comminuting apparatus in a relatively efficient and cost-effective manner, while also being able to handle a wide variety of severable materials.

The present invention provides a vastly improved comminuting apparatus that is also better able to recirculate and sort severed solid waste material in the separator screen particularly in an apparatus having a simplified construction with fewer parts, which is less costly to manufacture, maintain and repair, and is more reliable. It is also better able to sever the material at a desired speed, or line speed, in a feed-controlled manner from a web of material being received from a processing machine. Accordingly, the present invention provides an apparatus that is able to feed solid waste material into the comminuting apparatus in a feed-controlled manner.

SUMMARY OF THE INVENTION

A self-feeding comminuting apparatus is provided having improved access, maintenance and cleaning features.

According to one aspect of the invention, a comminuting apparatus is provided with a housing, at least two intermeshing scissor rolls, a screen, and an access tray. The housing has an entrance opening for receiving waste material and an exit opening for removing subdivided waste material. The scissor rolls are carried within the housing between the entrance opening and the exit opening for subdividing the waste material. The screen is carried by the housing between the scissor rolls and the exit opening. The access tray is provided by the housing and is removably supported downstream of the screen to provide a shear outtake manifold between the screen and the access tray.

According to another aspect, a hatch assembly is provided for accessing inside surfaces of a comminuting apparatus. The hatch assembly includes a frame and a tray. The tray is removably supported by the frame and is configured to retain and release the tray with the frame by respectively latching and unlatching the tray relative to the frame.

According to yet another aspect, a removable sorting screen assembly is provided for a comminuting apparatus. The assembly includes a frame, a screen, a housing member, and a hand-actuatable latch. The screen is carried by the frame for sorting subdivided material. The housing member includes a concave portion defining at least in part a shear outtake manifold, the housing member removably affixed to the frame and configured to cover an opening provided in a housing of the comminuting apparatus. The hand-actuatable latch is configured for latching and unlatching the housing member from the frame.

According to even another aspect, a comminuting apparatus is provided with an enclosure, a frame, cutting knives, a screen, and a drop tray. The enclosure has an entrance opening and an exit opening. The frame is configured to support the enclosure. The cutting knives are supported within the enclosure by the frame. The screen is provided between the cutting knives and the exit opening. The screen is operative to sort subdivided pieces of waste material. The drop tray is provided downstream of the screen and upstream of the exit opening. The drop tray is configured to cover an opening in the enclosure and further provide a shear outtake manifold downstream of the screen. The drop tray has a hand release assembly configured to mate and demate the drop tray with the frame.

BRIEF DESCRIPTION OF THE DRAWINGS

Preferred embodiments of the invention are described below with reference to the following accompanying drawings, which are briefly described below.

FIG. 4 is a left side view of the apparatus illustrated in FIGS. 1 and 2;

FIG. 10 is a cross-sectional view taken along line 10—10 in FIG. 5 but with the screen removed.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 5:
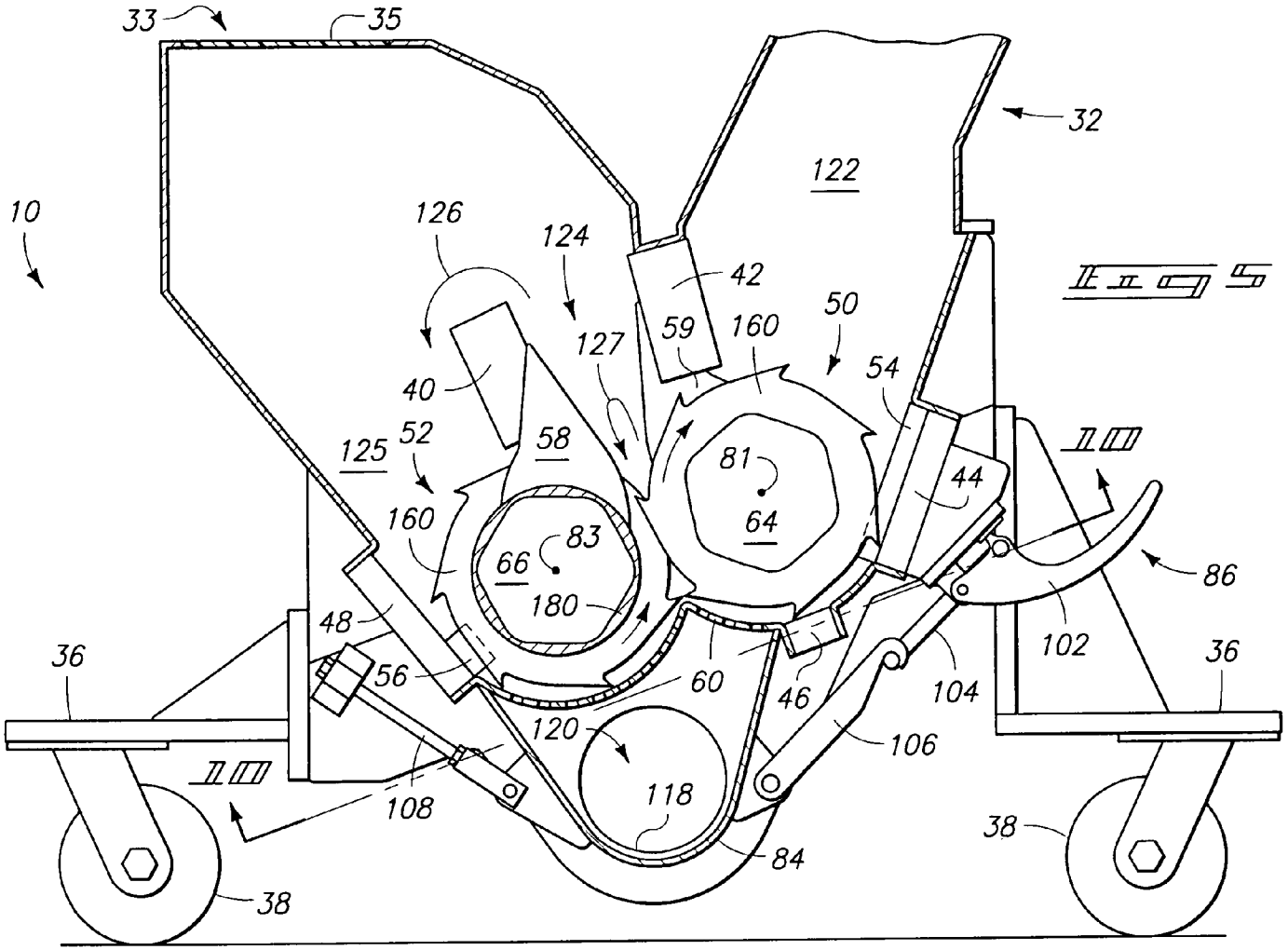
FIG. 5 is an enlarged transverse vertical cross-sectional and partial view taken along line 5—5 in FIG. 1 illustrating the interior of the apparatus.
Figure 6:
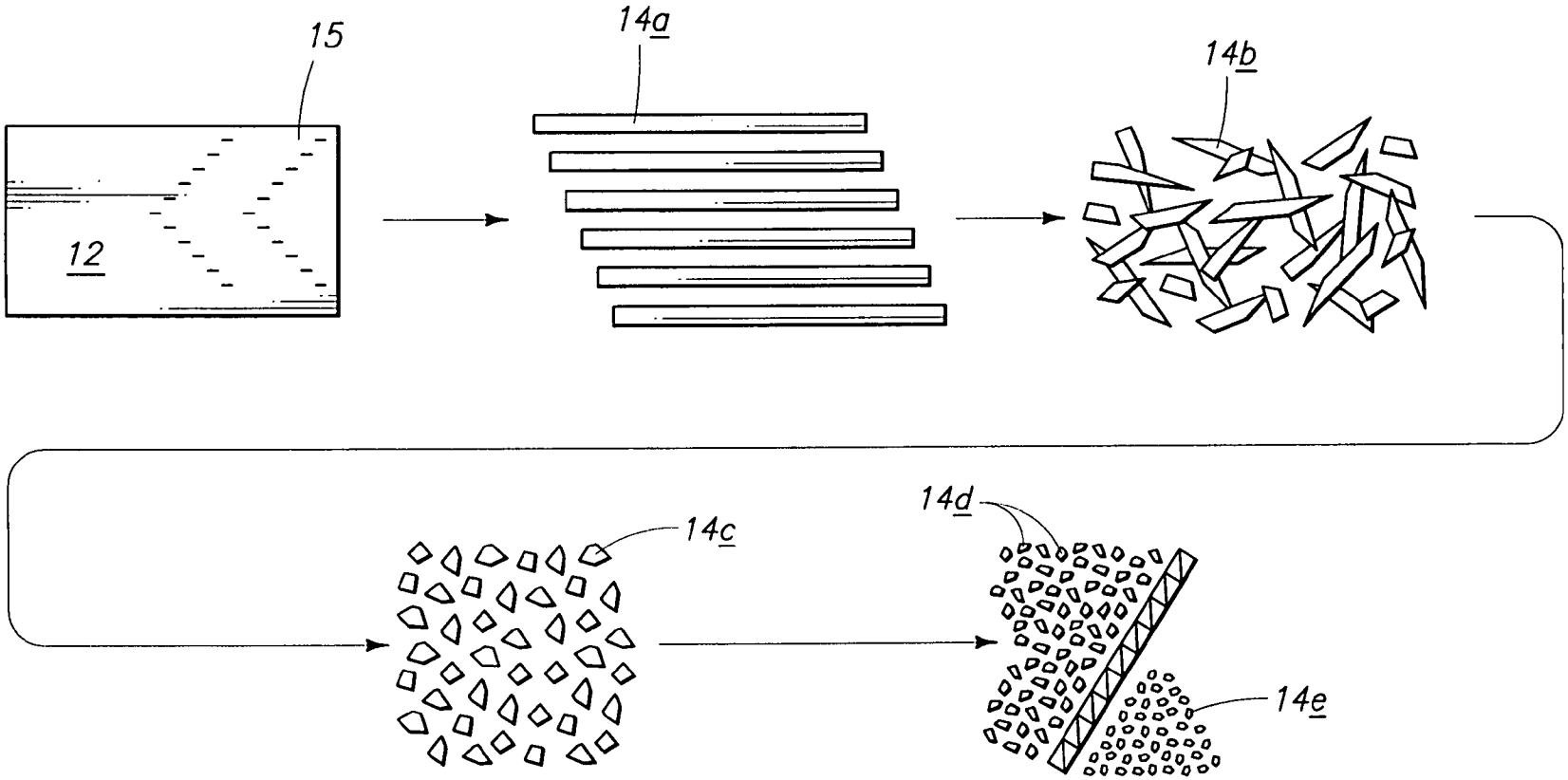
FIG. 6 is a series of illustration views of the waste material and the reduction of the waste material into smaller and smaller particles of the material as it is progressively processed and reduced to a desired particulate size.

A preferred embodiment of the invention is illustrated in the accompanying drawings particularly showing a waste comminuting apparatus generally designated with the numeral 10 in FIGS. 1–5 for receiving solid waste material 12 and for reducing the solid waste material progressively into smaller and smaller sizes until the desired small particulate or piece size is obtained as illustrated in FIG. 6.

It should be noted that the apparatus 10 is very compact even though the material is progressively reduced in size in several stages to a desired predetermined small size. The predetermined small piece size will generally depend upon the desires of the customer, the end use, and the particular material being comminuted. The solid waste material 12, illustrated in FIG. 6, is progressively reduced to subdivided pieces 14*a* through 14*e*. When the subdivided pieces are generally reduced to the desired small size, 14*e*, they are removed from the apparatus as the final product. Those subdivided pieces that have not been sufficiently reduced to the desired small size are reprocessed or recycled until they are sufficiently reduced to the desired size.

The apparatus 10 has a general frame 16 that may be self-supported or affixed to other apparatus, such as the discharge of a thermal-forming, or thermoforming, machine, for receiving the solid waste material 12 directly from a thermoforming machine and reducing the material for reuse. Frame 16 generally includes a general enclosure 18 that includes a front wall 20, side walls 22 and 24, a back wall 26, a bottom wall 28, and a top wall 30. Top wall 30 has a material receiving duct 32 having a material entrance 62 (see FIGS. 1–4), through which the solid waste material is fed into apparatus 10. General frame 16 may be supported on legs 36 that each have individual pairs of wheels 38 at each end. General frame 16 preferably includes walls 20–30, upper frame members 40, 42, 44 and 48 and cross-member 46 that are variously illustrated in FIGS. 1–5.

Within the enclosure 18, two scissor rolls 50 and 52 are mounted in an intermeshing relationship for rotation in opposite directions, or co-rotation, in coordination with each other to receive the solid waste material 12 after being delivered via scissor roll 50. Scissor roll 50 provides a feed roll, delivering sheet material 12 in a speed controlled manner between scissor rolls 50 and 52 to shear the solid material as the material passes between scissor rolls 50 and 52 (see FIG. 5). Scissor rolls 50 and 52 are each supported at each end by a bearing similar to bearing 157 of FIG. 10. Scissor rolls 50 and 52 are positioned within enclosure 18 between an intake manifold 122 that receives the material through entrance 62. The material, after passing through the scissor rolls 50 and 52 from beneath, ascends into a recycle manifold 124 (see FIG. 5) that communicates with a recirculation cavity 125 via recycle flow path 126.

Scissor roll 50 is mounted on a shaft 64 that rotates about axis 81 (see FIG. 5). Scissor roll 52 is mounted on a shaft 66 that rotates about axis 83. Axes 81 and 83 are substantially parallel with each other, both extending horizontally, and extending between the side walls 22 and 24. However, scissor roll 50 is elevated relative to scissor roll 52 such that axis 81 and axis 83 lie in a common plane that is inclined relative to a horizontal plane. According to one construction, the resulting inclined plane lies at an angle θ (see FIG. 7) from about 15 to about 45 degrees. Axes 81 and 83 are positioned so that scissor rolls 50 and 52 have sufficient overlap to shear the material between the scissor rolls as the material passes between the rolls.

Figure 7:
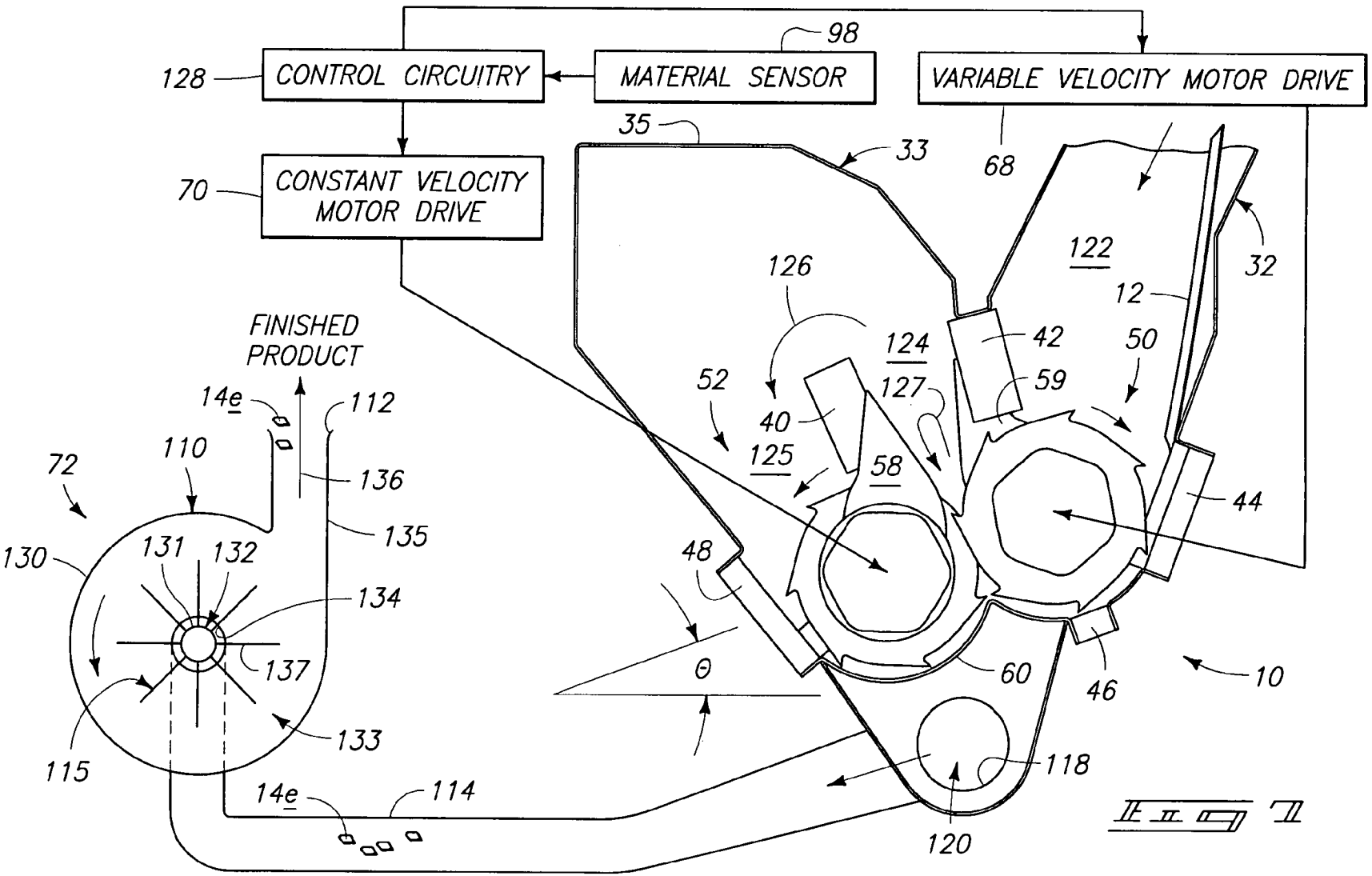
FIG. 7 is a product flow illustrated diagram showing the flow path of the waste material through the apparatus as the material is being progressively processed and reduced to the desired particulate size.

As shown in FIG. 7, comminuting apparatus 10 provides a system for comminuting material 12 utilizing feedback signals from sensor 98 to controllably regulate rotational velocity of scissor roll 50. Sensor 98 detects a material condition to enable the operation of apparatus 10 substantially at a feed velocity of material 12 corresponding, for example, with a line speed of material 12 being received from a thermoforming machine. Inclination angle θ is provided between scissor rolls 50 and 52 which enables a more compact construction of recycle housing 33 because material is comminuted between rolls 50 and 52 and spills over cross-member 40 via recycle flow path 126 in a much more compact and efficient manner. It has been found that utilization of a horizontal arrangement of scissor rolls and a vertically arrayed recycle manifold section tends to cause stacking or piling of comminuted material elevationally above the pair of scissor rolls, and is not conducive to generating recirculation of comminuted material over recycle flow path 126. Accordingly, clogging and stacking can reduce efficiency, and can mandate that housing 33 be configured elevationally higher to accommodate such stacking. Accordingly, the bias angle θ between scissor rolls 50 and 52 allows for a more compact housing 35, and enhances recycling the comminuted material via recycling flow path 126.

As shown in FIG. 5, shafts 64 and 66 are supported for rotation at each end by respective bearings 157 (see FIG. 10). Each of shafts 64 and 66 has hexagonal cross-sectional profiles, providing angular drive surfaces 158 (see FIGS. 8 and 9).

Figure 8:
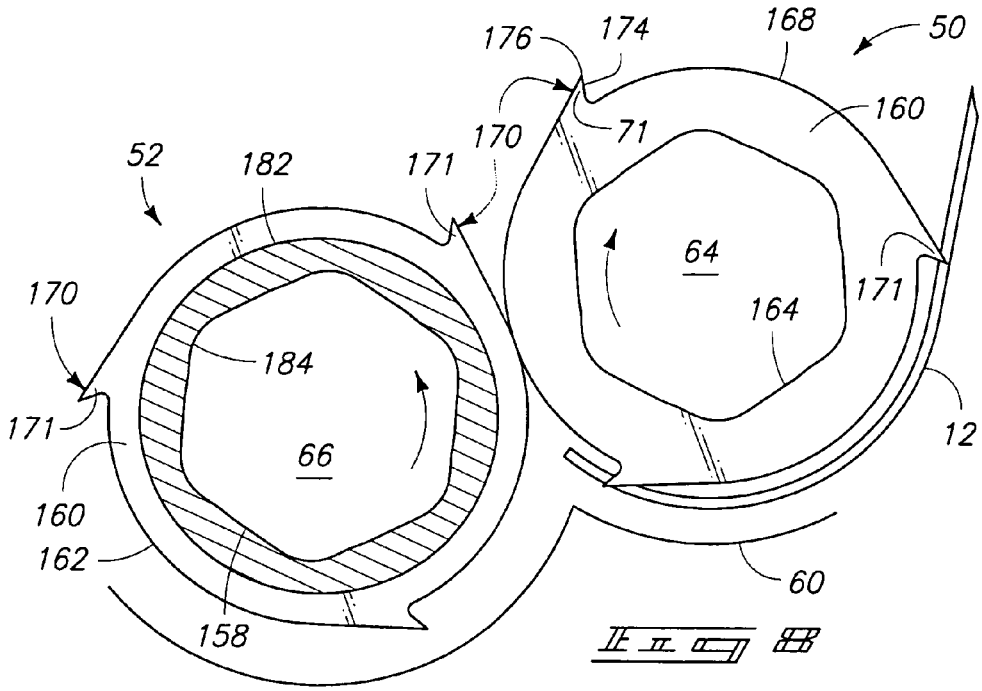
FIG. 8 is an isolated vertical cross-sectional view taken along line 8—8 in FIG. 10 of a set of scissor roll rings and feed gears on a servo feed roll illustrating the initial entrance and feeding of a piece of waste material between the scissor rolls.
Figure 9:
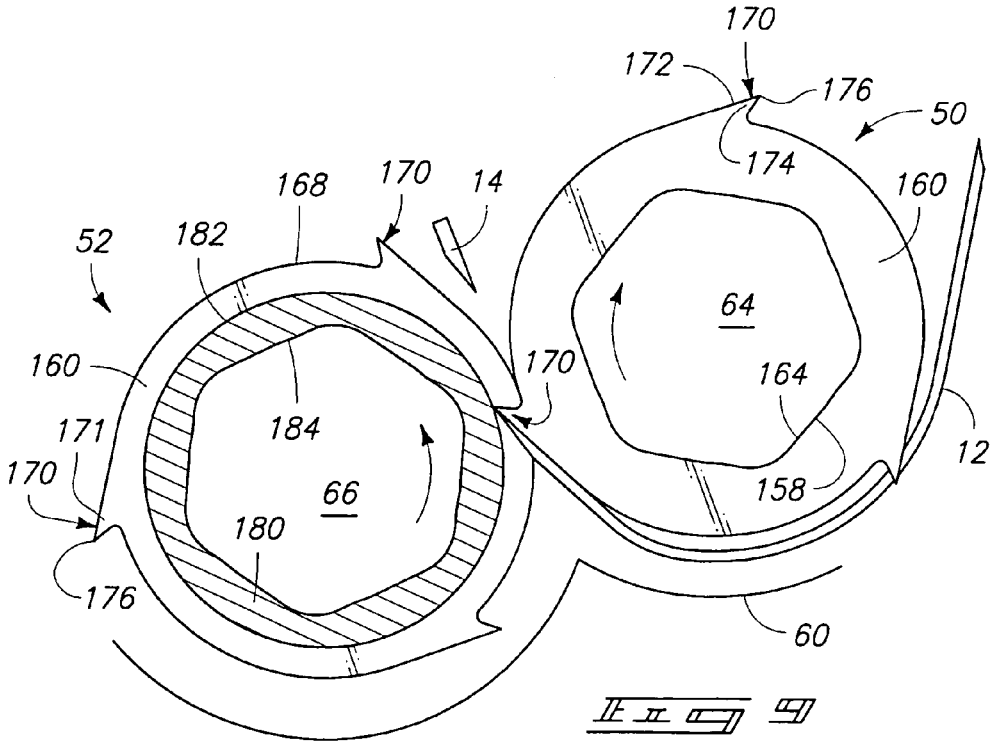
FIG. 9 is an isolated vertical cross-sectional view similar to FIG. 8 taken along line 9—9 in FIG. 10, except showing the scissor roll rings incrementally rotated to feed and sever the piece of waste material.
Figures 9, 11:
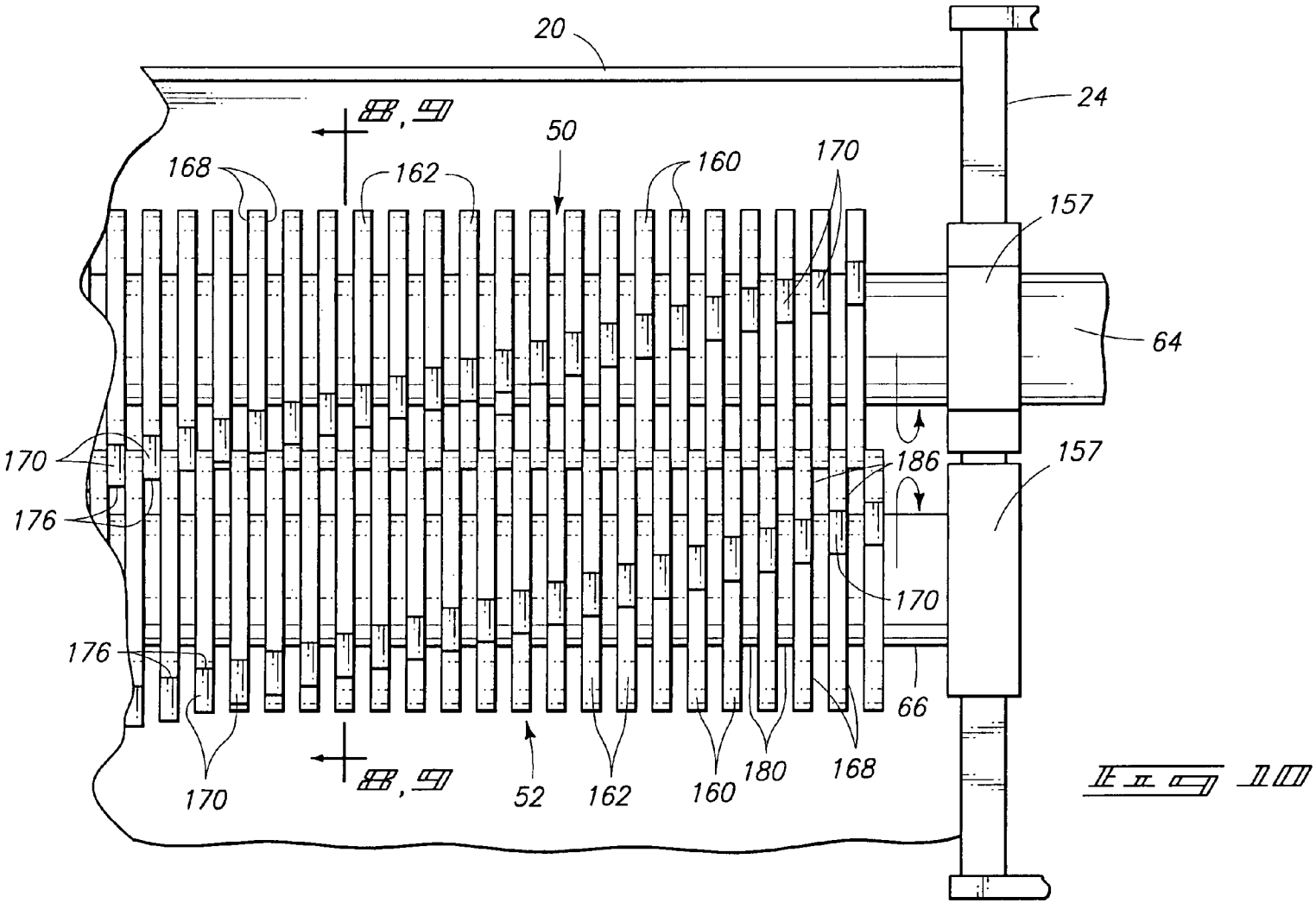

Each of scissor rolls 50 and 52 includes a plurality of scissor rings 160 in which each of the rings 160 has an outer circular peripheral surface 162 and an inner hexagonal bearing surface 164 that is complementary to the profile of shafts 64 and 66 so that the scissor rings 160 rotate in response to the rotation of shafts 64 and 66 (see FIGS. 8 and 9). Each of the scissor rings 160 includes side surfaces that form shearing edges 168 with the outer peripheral surface 162 (see FIG. 10).

In the preferred embodiment, each of scissor rings 160 has evenly angularly spaced finger knives 170 formed integrally on the scissor rings 160 and projecting radially outward of the surface 162 and forward in the direction of rotation for gripping, puncturing and transversely cutting the solid material 12, as illustrated in FIGS. 8 and 9. Each of the finger knives 170 includes a projecting body 171 that projects radially outward from the peripheral surface 162 and projects forward in the direction of rotation. Each of the finger knives 170 includes a side shearing surface 172 and an undercut surface 174, forming a sharp knife point 176. The scissor ring finger knives 170 are intended to grip, puncture and transverse the cuttage piece as it is being sheared between rings 160.

Each of the scissor rolls 50 and 52 further include a plurality of ring spacers 180. Each spacer 180 has a circular outer peripheral surface 182 and an inner hexagonal surface 184 (see FIGS. 8 and 9). Circular outer peripheral surface 182 of each spacer 180 has a groove sized to receive the corresponding stripper finger 58 and 59 of one of frame members 42 and 40, respectively (see FIG. 5). The corresponding circumferential groove is not indicated with a reference numeral due to its relatively thin profile in order to facilitate simplification of the drawings. The corresponding groove is sized such that fingers 58 and 59 are smoothly and cleanly received therein, preventing fingers 58 and 59 from scraping the sides of each adjacent scissor ring 160.

Accordingly, each of the ring spacers 180 has a width that is slightly greater than the width of the spacer rings 160. Each of the spacer rings 160 and ring spacers 180 are alternately positioned on shafts 64 and 66 so that a scissor ring 170 on one scissor roll opposes a corresponding ring spacer 180 on the other scissor roll, creating a circular inter-roll cavity 186 (see FIG. 10) between the adjacent rings and outward of the intermediate ring spacers 180. Once the material 12 is cut and sheared, it is received in the inter-roll cavity 186 (see FIG. 10) and passes between scissor rolls 50 and 52 into the recycling manifold 124.

The axes 81 and 83 of the scissor rolls are sufficiently spaced so that there is a slight overlap of approximately one-eighth inch (⅛") in the profile of the scissor rings so that as they are rotated, the material is sheared by the shearing edges 168 and the finger knife 170 as a profile of the scissor ring 160 moves into the circular inter-roll cavity 186 of the opposing ring spacer 180 (see FIG. 10).

As shown in FIG. 5, once material 12 is cut and sheared by scissor rolls 50 and 52, it is carried into recycle manifold 124, which communicates with, and is formed in part by recycle flow path 126 and recirculation cavity 125. Once cut and sheared material 12 collects in manifold 124 to a sufficient height, it cascades over the top portion of frame member 40, falling into recirculation cavity 125, where it is recycled via scissor roll 52. More particularly, scissor roll 52 draws the material 12 between roll 52 and screen 60, and upward between scissor rolls 50 and 52 for further comminuting. In this manner, cut and sheared material is again fed via scissor roll 52, which serves as a feed roll, back into scissor rolls 50 and 52 by passing it between scissor roll 52 and screen 60 where individual teeth on scissor ring 160 convey and deliver sheet of material 12, along with recirculated cut and sheared material back to roll 52 for further delivery, sorting and/or severing.

Material 12, which has passed over flow path 126 and has been directed to scissor roll 52, is thus recirculated via projecting bodies 171 (see FIG. 8) of scissor ring 160 back to scissor roll 52, where it is reprocessed between rolls 50 and 52 for delivery back into recycling manifold 124.

Particles 14*e* of sufficiently small size are separated out via a perforated plate, or separator screen, 60, which is provided immediately below and adjacent to rolls 50 and 52, conforming to their general nested bottom edge configuration. Here, screen 60 has the shape of a bi-concave perforated plate. Apertures in screen 60 are sized such that sufficiently small particles 14*e* drop through screen 60 where they are collected via a collector tray, or drop pan, 84. Tray 84 is releasably supported to frame 16 via a pair of handle release assemblies 86. When held in place, tray 84 also holds screen 60 in place, which facilitates quick and efficient disassembly for cleaning and maintenance.

Collected particles 14*e*, present within tray 84, are then withdrawn through an outlet 118 (see FIGS. 5 and 7) by way of a pneumatic conveyor 72. An air vent is provided at an opposite end of tray 84 from outlet 96 in order to ventilate outlet 96 when removing particles 14*e*. Particles 14*a–d* which are not sufficiently small enough to pass through screen 60 continue to be recirculated between rolls 50 and 52 via scissor roll 52.

Additionally, it has been discovered that some of the recirculated pieces 14*a–e* in recycle manifold 124 are sifted, or passed, in a reverse direction along flow path 127 where they fall backwards, or in reverse, between inner-roll cavities 186 (see FIG. 10) and return to screen 60. In this manner, particles which have sufficiently small size 14*e* are sifted by falling back via flow path 127 to screen 60 where they are collected in tray 84. Likewise, particles that fall back, but that are not sufficiently small in size, such as particles 14*a–d*, are passed down through rolls 50 and 52 where they are reprocessed and delivered upwardly to be further recycled via manifold 124, flow path 126 and recirculation cavity 125.

As shown in FIG. 5, a plurality of feeding fingers 54 are provided adjacent scissor roll 50 in order to further facilitate the piercing and driving of material as it is fed from intake manifold 122 between scissor roll 50 and screen 60. More particularly, each individual feeding finger 54 comprises a metal bar sized to fit in the gap provided between adjacent scissor rings 160 (see FIG. 10). Similarly, a plurality of metering fingers 56 are provided along scissor roll 52 to meter the delivery of recycled, or recirculated, material from recirculation cavity 125 and between scissor roll 52 and screen 60. Each metering finger 56 is configured to be received within the inner space cavity formed between adjacent scissor rings 160 (see FIG. 10).

As shown in FIG. 5, screen 60 is carried at each end by respective edge portions of tray 84 so as to be presented in inter-nested adjacent relation with scissor rolls 50 and 52. Screen 60 is quickly and easily removed for maintenance, repair and/or cleaning by releasing hand release assemblies 86 such that retaining loops 104 can be releasably removed from the clasp bars 106 which facilitate the dropping of tray 84 and removal of screen 60. Screen 60 and tray 84 are re-secured by latching loops 104 onto clasp bars 106 and securing respective hand release assemblies 86, including pivotally latching and securing individual handles 102. When released to a drop position, tray 84 is allowed to pivotally drop with respect to retention bars 108 which are provided at either end. A pivot is formed between retention bars 108 and tray 84 which facilitates the downward displacement of tray 84 when unlatched for cleaning and/or maintenance. Additionally, screen 60 is further secured into engagement with cross-members 46 and 48.

Figure 1:
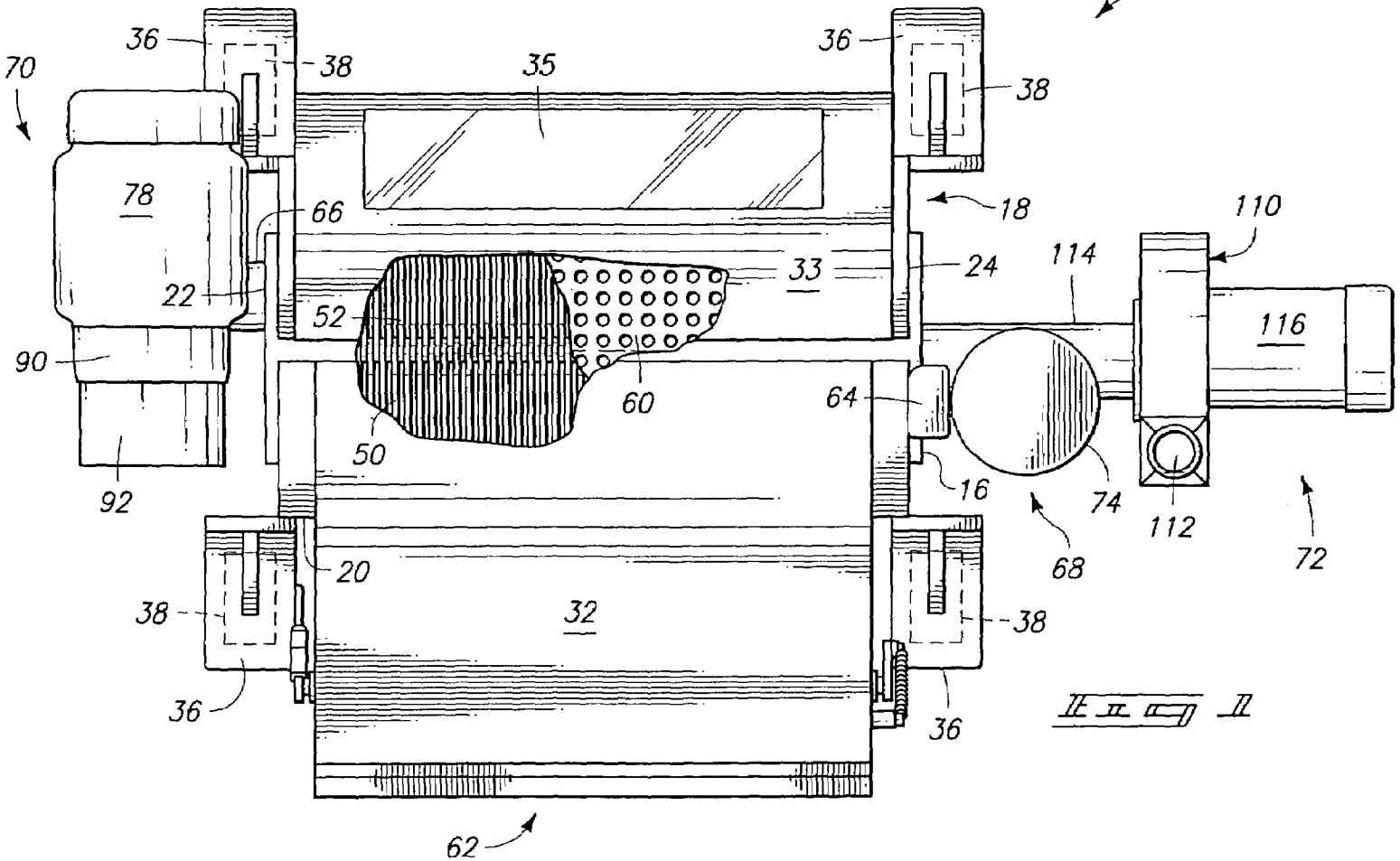
FIG. 1 is a plan view of a preferred embodiment of the apparatus illustrating the top exterior of the apparatus with one waste material entrance having a portion broken away to show the scissor rolls and screen.
Figure 2:
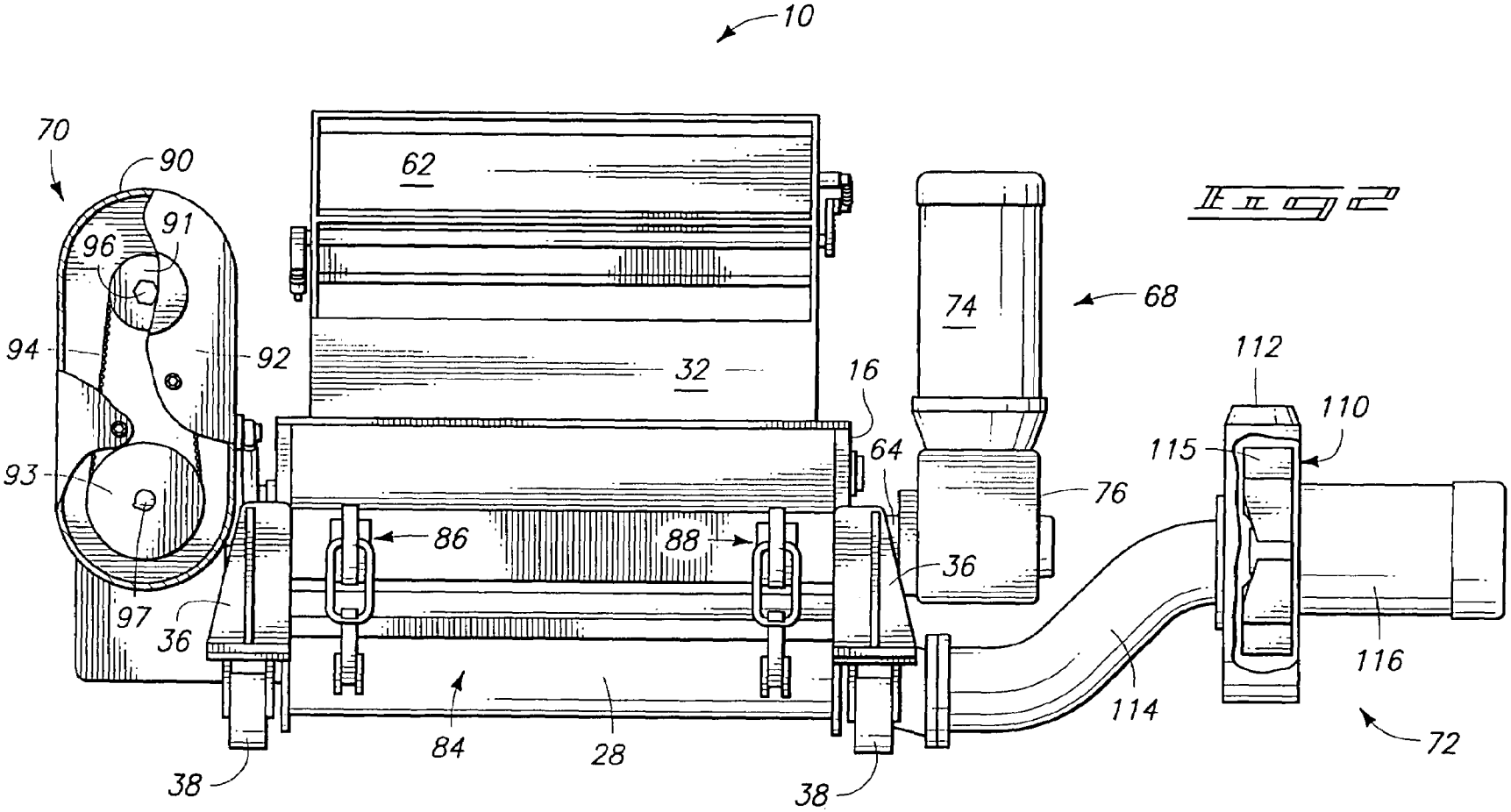
FIG. 2 is a front view of the apparatus illustrated in FIG. 1.

Intake manifold 122 is configured to receive sheet material from entrance 62 of material receiving duct 32, illustrated in FIGS. 1 and 2. New solid waste material 12 enters through one of material entrance 62 via associated material receiving duct 32 and subdivided material requiring additional recycling is recirculated via a recycling manifold section 124 where it is re-delivered by way of recycle flow path 126 to recirculation cavity 125, or it is alternatively returned via reverse sort path 127 for sifting in screen 60 or further severing and subdividing via rolls 50 and 52.

The outtake manifold 120 includes an outlet 118 (FIGS. 5 and 7) and a collection tray 84 with a pneumatic conveyor 72 facilitating the removal of the smaller-sized severed pieces 14*e* from the outtake manifold 120 and to entrain such pieces 14*e* in an airstream via an outtake pipe 114 (see FIG. 7) and pneumatic conveyor 72. Outtake pipe 114 provides an airstream conduit for directing an airstream with entrained subdivided pieces from the shear outtake manifold 120 to an outer volute duct 135 along flow path 136 to a product outlet 112 (see FIG. 8).

The apparatus 10 includes a pair of scissor roll drive motor assemblies generally designated with the reference numerals 68 and 70 and illustrated in FIGS. 1–4. Drive motor assembly 68 comprises a variable speed drive motor assembly that includes a variable speed AC drive motor 74, a speed reduction gearbox 76, and a flux vector AC drive (not shown) which is housed in electrical cabinet 82 (of FIG. 3). Similarly, drive motor assembly 70 comprises a three-phase AC motor 78 and a speed reduction gearbox 80.

More particularly, variable speed drive motor assembly 68 is configured to drive scissor roll 50 (of FIG. 5) at a regulated speed pursuant to the control system features disclosed relative to FIG. 7. A feedback signal is provided by way of material sensor 98 (of FIG. 3) which detects tension that is placed upon sheet material 12 as it is received within duct 32. Tension is applied to sheet 12 when scissor roll 50 is operating at a speed which exceeds the speed with which such material is being admitted into duct 32. Accordingly, the control system feature depicted with reference to FIG. 7 allows for variable speed operation of scissor roll 50 by way of variable speed drive motor assembly 68. According to one construction, a variable speed electric drive motor sold by Sumitomo Machinery Corporation of America is utilized for motor 74. A corresponding flux vector AC drive is also used with such motor. According to one construction, a model NTAC-2000 sensorless flux vector AC drive is utilized with motor 74, as sold by Sumitomo Machinery Corporation of America. Such motor and drive cooperate to provide a microcontrolled variable speed drive motor assembly capable of realizing the features depicted in FIG. 7.

More particularly, three-phase AC motor 78 comprises a 15 hp standard electric motor using contactors and fuses. As shown in FIGS. 2 and 4, motor 78 is coupled to drive gearbox 80 by way of a chain or belt 94 extending between a pair of associated pulleys 91 and 93 mounted to shafts 96 and 98, respectively. Chain, or belt, 94 is contained within a pulley drive cover 92 which is supported on a bracket 90. Motor 78 is configured to operate at a constant operating speed. However, it is understood that the dimensions of pulleys 91 and 93 can be changed in order to configure motor 78 and gearbox 80 to operate at a different operating speed which proves suitable for use with a specific machine and/or application. For example, it may be desirable to change the substantially constant operating speed of a scissor roll 52 (of FIG. 5) when comminuting a specific type of material. Accordingly, such change in constant velocity can be made by specifically configuring the size of the pulleys for a specific machine utilization.

In operation, the ability to rotate scissor roll 52 at a substantially constant velocity, while regulating the variable velocity operation of scissor roll 50 enables the controlled metering of material being fed into the apparatus 10 for comminuting relative to the speed with which material is being provided to such apparatus.

As shown in FIG. 2, motor 74 is directly mounted onto gearbox 76 where it is supported thereon, as gearbox 76 is mounted onto frame 16 (of apparatus 10). Likewise, motor 78 is carried by bracket, or plate, 90 via gearbox 80, which is likewise mounted to frame 16. Additionally, each of gearboxes 76 and 80 are further secured to frame 16 by additional framework (not shown) such as by use of struts that are tied to the side walls 22 and 24 and frame 16.

Furthermore, where belt 94 is utilized, pulleys 91 and 93 are utilized. However, where a chain is utilized, pulleys 91 and 93 are replaced by a pair of sprockets which couple together the respective motor and gearbox.

As shown in FIG. 7, control circuitry 128, in the form of a microprocessor or microcontroller, receives a material status signal from material sensor 98 indicating the status of material being received within apparatus 10. Control circuitry 128 then sends an output signal to variable velocity drive motor assembly 68 which regulates the rotational speed of scissor roll 50. As shown in FIG. 7, control circuitry 128 also provides an input signal to constant velocity drive motor assembly 70. According to one construction, such input signal merely comprises a signal that turns on and off the constant velocity drive motor assembly 70 so as to start and stop motion of scissor roll 52. Accordingly, FIG. 7 illustrates a feedback control system utilizing control circuitry 128 and sensor 98 so as to vary the rate at which material 12 is fed into scissor rolls 50 and 52 based upon the detected status of material 12 entering intake manifold 122. Where the operating speed of scissor roll 50 exceeds the delivery speed of material 12 into apparatus 10, tension will be exerted on material 12 which causes sensor 98 to detect such condition (see FIG. 3).

Figure 3:
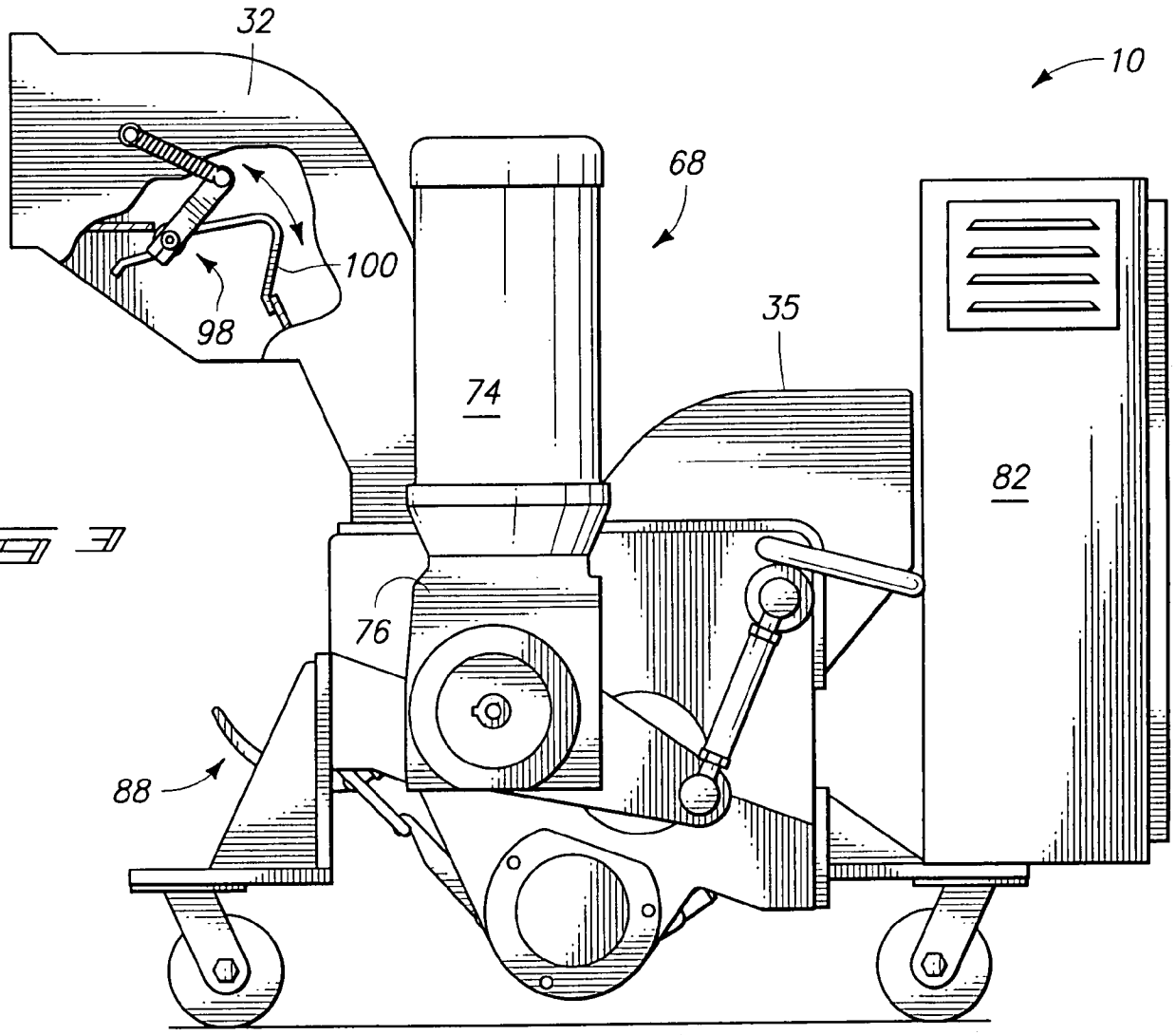
FIG. 3 is a right side view of the apparatus illustrated in FIGS. 1 and 2.
Figure 11:
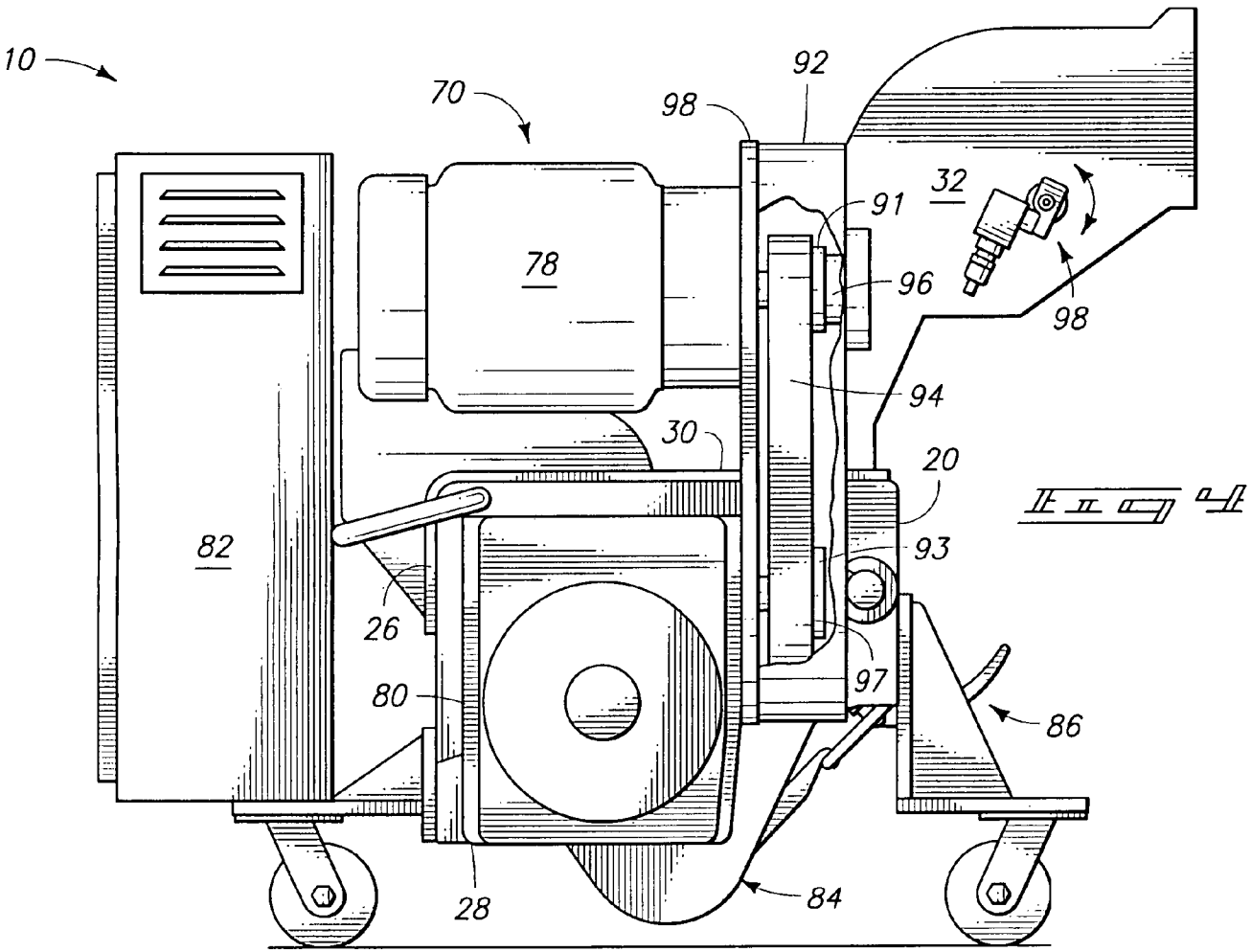

As shown in FIG. 3, sensor 98 comprises an angled sheet metal plate 100 that includes an actuator arm. Such plate 100 and actuator arm are pivotally supported relative to duct 32, and are biased towards an upwardly raised or elevated position by way of a coil spring. Application of tension on a sheet of material extending thereabout causes plate 100 to be downwardly biased so as to coact against such coil spring. As shown in FIG. 4, sensor 98 includes a microswitch which detects the rotated position of plate 100. The detected downward rotation of plate 100 sends a signal to control circuitry 128 (of FIG. 7) which provides a feedback signal on the status of material being received within apparatus 10. Accordingly, the operating velocity of scissor roll 50 can be adjusted so as to maximize operating efficiency for a particular detected status of material 12 being received within intake manifold 122 based upon detected sheet material tension.

Accordingly, scissor roll 50 can be operated as a feed roll that is rotated at a desired speed for a particular material 12 being received within apparatus 10, as shown in FIG. 7. Such a feedback control system ensures optimized performance of apparatus 10 under a number of operating conditions and/or when being utilized with a number of different materials 12. For example, web 12 can comprise a web of material being received from a thermoforming press. Material 12 is drawn via scissor roll 50 substantially at a line speed by actuating variable velocity drive motor assembly 68 according to an input signal being received from material sensor 98. Accordingly, operating speeds and efficiencies can be maximized by variably regulating the rotational speed of scissor roll 50.

Apparatus 10 further includes a pneumatic conveyor 72, as shown in FIG. 7, for conveying subdivided pieces 14 from outtake manifold 120 and directing the pieces to a product outlet 112. Product outlet 112 ejects the pieces 14*e* where the sufficiently small subdivided pieces 14*e* are collected in a storage vessel (not shown) for later recycling.

The pneumatic conveyor 72 includes a centrifugal fan 110 for generating an airstream of sufficient velocity and volume to remove the subdivided pieces from the shear outtake manifold 120 and to entrain the pieces 14*e* in the airstream (see FIGS. 5 and 7). The centrifugal fan 110, illustrated in FIG. 7, includes a housing 130 having a central propeller section 115, a peripheral volute section 133, and an outer volute duct 135. The central propeller section 115 includes a central inlet 134 with a propeller assembly 132 mounted within the central propeller section 115. The propeller assembly 132 includes a shaft 131 with radial blades 137 extending radially outward for directing the air from the central inlet 134 radially outward and tangential into the peripheral volute section 133. A motor 116 (see FIG. 1) is connected to the shaft 131 (see FIG. 7) for rotating the blades 137 at the desired speed to obtain an airstream having the desired velocity and volume.

Centrifugal fan 110 communicates with outer volute duct 135 and product outlet 112 for discharging the small particles 14*e* that have passed through the separator screen 60 via outtake pipe 114.

As illustrated in FIGS. 5 and 7, the cross-frame members 40 and 42, each comprising a stripper plate, each have notched stripping fingers 58 and 59, respectively, formed along an edge thereof projecting between the scissor rings 160 and into the inter-roll cavities 186 along the lower profile of the scissor rolls 50 and 52 to strip any of the subdivided pieces from between the scissor rings 160 after the pieces have been severed. In one version, each finger is secured to each plate with one or more fasteners (not shown). Each finger 58, 59 rides in a complementary groove (not numbered) in the radial outer surface of ring spacer 80 (of FIG. 5).

During the operation of the apparatus 10, solid waste material 12 is fed into the apparatus 10 through entrances 62 of duct 32 (see FIGS. 1, 3 and 4) and into the intake manifold 122 where it is directed to the scissor roll 50 (see FIGS. 5 and 7). Scissor roll 50 then moves the material along feeding fingers 54, pulling the material 12 between scissor roll 50 and feeding fingers 54. The engaged material is delivered by scissor roll 50 along screen 60. In some cases, feeding fingers 54 can also help to sever material 12 during delivery between scissor rolls 50 and 52. Scissor roll 50 then further engages the material, causing some of the material to rip and sever, as roll 50 is rotated. Scissor roll 50 then delivers or circulates the material along screen 60 for sorting and between rolls 50 and 52 where it is engaged and severed.

As the delivered material 12 engages rolls 50 and 52, material 12 is gripped by the finger knives 170 (see FIGS. 8 and 9) and pulled between the scissor rolls 50 and 52, with the scissor rings 160 and its shearing edges 168 shearing the solid waste material into subdivided pieces. As previously mentioned, the finger knives 170 grip the material, puncture the material and transversely cut the material even further as it passes between the rolls. The severed pieces 14*a*–14*e* (see FIG. 6) then ascend into the recycle manifold section 124. The stripper fingers 58 and 59 strip any severed pieces from the rolls 52 and 50, respectively, and remove them into the recycle manifold section 124.

After material and subdivided pieces 14*a*–*e* are delivered to scissor roll 50, scissor roll 50 in combination with scissor roll 52 further delivers the pieces along screen 60 where small subdivided pieces 14*e* are separated from the remaining material and pieces. Those subdivided pieces that are larger than the apertures or holes in the separator screen 60 are carried along rolls 50 and 52 where they are delivered between rolls 50 and 52 for further severing and subdividing, or comminuting. The further subdivided pieces are then delivered into recycle manifold section 124. Such further subdivided pieces 14*a*–14*e* are then either re-delivered via recycle flow path 126 to recirculation cavity 125 for further delivery and subdividing, or are received in a reverse direction via reverse-direction sort path 127 back along screen 60 where sufficiently small particles 14*e* are separated out through screen 60 and remaining portions are further subdivided between rolls 50 and 52. The small pieces 14*e* that pass through the separator screen 60 are directed from the apparatus through the product outlet 118 to a pneumatic conveyor 72 for delivery to final product outlet 112.

The large particles or pieces 14*a*–14*e* will be continually recycled through recycle flow paths 126 or 127 until their size is reduced below that of the preselected size of the apertures of the separator screen 60. Screen 60 can be easily replaced in order to provide apertures with a desired size for implementing a desired sort of particles. Screen 60 can be constructed from screen material or any suitable perforated sheet or plate, or other suitable construction.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A comminuting apparatus, comprising:

a housing with an entrance opening for receiving waste material and an exit opening for removing subdivided waste material;

at least two intermeshing scissor rolls carried within the housing between the entrance opening and the exit opening for subdividing the waste material;

a screen carried by the housing between the scissor rolls and the exit opening;

an access tray provided by the housing and removably supported downstream of the screen to provide a shear outtake manifold between the screen and the access tray; and at least one hand-actuated release assembly configured to removably couple the access tray with an adjacent portion of the housing.

2. The comminuting apparatus of claim 1, wherein the housing comprises a frame and an enclosure supported by the frame.

3. The comminuting apparatus of claim 2, wherein the enclosure comprises a plurality of walls carried by the frame.

4. The comminuting apparatus of claim 3, wherein one wall comprises a bottom wall, and the access tray is provided in the bottom wall.

5. The comminuting apparatus of claim 2, wherein the access tray has spaced-apart upper edges configured to removably retain the screen along respective opposed edges against the frame and within the housing.

6. The comminuting apparatus of claim 2, wherein the access tray is removably latched to and unlatched from the frame to provide an access opening in the housing to facilitate at least one of maintenance, repair, and cleaning within the comminuting apparatus.

7. The comminuting apparatus of claim 1, wherein the release assembly comprises a handle pivotably supported by the housing and configured to secure and release the access tray from the housing.

8. The comminuting apparatus of claim 7, wherein the release assembly further comprises a retaining loop pivotally supported by the handle at one end and releasably connected with a clasp bar at another end, wherein the clasp bar is carried by the access tray.

9. The comminuting apparatus of claim 8 further comprising a retention bar carried by the housing adjacent the access tray at one end and pivotally carried by the access tray at an opposite end, wherein the access tray decouples from the housing when the handle is pivotally released to disconnect the retaining loop from the clasp bar.

10. The comminuting apparatus of claim 1, wherein the access tray is removably mated and demated with a surrounding portion of the housing between a latched and an unlatched position, wherein the unlatched position corresponds with the access tray being separated from the housing.

11. The comminuting apparatus of claim 1, wherein the access tray comprises a U-shaped channel having a pair of upwardly extending free edges and a crotch portion that cooperate in assembly with the housing to provide a shear outtake manifold.

12. The comminuting apparatus of claim 11, wherein the screen has a W-shaped cross-sectional configuration that internests beneath the scissor rolls, and wherein the free edges of the access tray engage with respective free edges of the screen to secure the screen to the housing.

13. The comminuting apparatus of claim 1, wherein the access tray extends a substantially entire length of the scissor rolls.

14. A comminuting apparatus, comprising:

an enclosure having an entrance opening and an exit opening;

a frame configured to support the enclosure;

cutting knives supported within the enclosure by the frame;

a screen provided between the cutting knives and the exit opening and operative to sort subdivided pieces of waste material; and a drop tray provided downstream of the screen and upstream of the exit opening and configured to cover an opening in the enclosure and further provide a shear outtake manifold downstream of the screen and having a hand release assembly configured to mate and demate the drop tray with the frame.

15. The apparatus of claim 14 further comprising a latch mechanism configured to retain and release the drop tray with the frame.

16. The apparatus of claim 15, wherein the drop tray retains the screen against the frame.

17. The apparatus of claim 15, wherein the drop tray includes a concave portion that provides at least in part a shear outtake manifold.

18. The apparatus of claim 14, further comprising a pair of intermeshing scissor rolls carried by the frame and providing the cutting knives.

19. A comminuting apparatus, comprising:

a housing having an access opening and an exit opening;

a material shredding device supported within the housing;

a screen provided between the material shredding device and the exit opening to sort subdivided pieces of waste material;

a removable hatch provided in association with the housing downstream of the screen and configured to removably cover the access opening to enable access to the material shredding device; and a hand release assembly configured to mate and demate the removable hatch with the housing.

20. The apparatus of claim 19, wherein the housing further comprises an entrance opening.

21. The apparatus of claim 19, wherein the hatch comprises an access tray having a pair of spaced-apart upper edges configured to removably retain the screen along respective opposed edges against the housing.

22. The apparatus of claim 19, wherein the hand release assembly comprises a handle pivotally supported by the housing and configured to secure and release the hatch from the housing.

23. The apparatus of claim 22, wherein the hand release assembly further comprises a retaining loop pivotally supported by the handle at one end and releasably connected with a clasp bar at another end, wherein the clasp bar is carried by the hatch.

24. The comminuting apparatus of claim 23 further comprising a retention bar carried by the housing adjacent the hatch at one end and pivotally carried by the hatch at an opposite end, wherein the hatch decouples from the housing when the handle is pivotally released to disconnect the retaining loop from the clasp bar.

25. The comminuting apparatus of claim 19, wherein the material shredding device comprises at least two intermeshing scissor rolls carried within the housing.

* * * * *

UNITED STATES PATENT AND TRADEMARK OFFICE

CERTIFICATE OF CORRECTION

PATENT NO. : 7,048,215 B2
APPLICATION NO. : 10/779219
DATED : May 23, 2006
INVENTOR(S) : Jere F. Irwin It is certified that error appears in the above-identified patent and that said Letters Patent is hereby corrected as shown below:

On title page, item 56 - References Cited, line 4 -
Replace "Grizinger"
With --Grinzinger--

Signed and Sealed this

Twenty-eighth Day of November, 2006

JON W. DUDAS
*Director of the United States Patent and Trademark Office*